US005285745A

United States Patent [19]

Husain

[11] Patent Number: 5,285,745

[45] Date of Patent: Feb. 15, 1994

[54] SYSTEM TO REDUCE SPILLAGE OF OIL DUE TO RUPTURE OF THE TANKS OF UNMANNED BARGES

[76] Inventor: Mo Husain, 908 Stratford Ct., Del Mar, Calif. 92014

[21] Appl. No.: 792,026

[22] Filed: Nov. 13, 1991

Related U.S. Application Data

[63] Continuation-in-part of Ser. No. 377,886, Jul. 10, 1989, Pat. No. 5,156,109, and Ser. No. 503,712, Apr. 3, 1990, Pat. No. 5,092,259.

[51] Int. Cl.[5] ..... B63B 43/00

[52] U.S. Cl. ..... 114/74 R; 114/211

[58] Field of Search ..... 114/72, 74 R, 211, 212, 114/74 T

[56] References Cited

FOREIGN PATENT DOCUMENTS 2031905 1/1971 Fed. Rep. of Germany .... 114/74 R 0035082 3/1977 Japan ..... 114/74 R

*Primary Examiner*—Edwin L. Swinehart

*Attorney, Agent, or Firm*—William C. Fuess

[57] ABSTRACT

A slight, 13.2 psia, underpressure is created, and dynamically maintained, in the ullage space of the oil tanks of an unmanned barge in order to prevent or reduce the spillage of oil due to any rupture of the tanks. The underpressure is created by ejecting a high pressure gas, preferably 500 psia inert nitrogen gas in a 16 $ft^3$ storage bottle, through an ejector that is also flow-connected to the ullage spaces of the barge's tanks. The gaseous mixture within the ullage space is preferably inerted so as to prevent combustion or explosion by mixing with the same high pressure inert gas that is otherwise used to energize the ejection. All flow connections are controlled by electric valves managed by a control computer that responds to tank level, pressure, and/or gaseous mixture sensors.

20 Claims, 5 Drawing Sheets

ANCILLARY RESOURCES

- POWER SUPPLY (BATTERY)
- SEALED COMPUTER
- SENSORS
- GAUGES
- SHUT-OFF VALVES
- CONTROL VALVES
- RELIEF VALVES
- ALARM

SYSTEM TO REDUCE SPILLAGE OF OIL DUE TO RUPTURE OF THE TANKS OF UNMANNED BARGES

REFERENCE TO RELATED PATENT APPLICATIONS

The present application is a continuation-in-part of U.S. patent application Ser. No. 377,886 filed Jul. 10, 1989 for a SYSTEM TO REDUCE SPILLAGE OF OIL DUE TO RUPTURE OF A SHIP'S TANK, now U.S. Pat. No. 5,156,109 and also of U.S. Patent application Ser. No. 503,712 filed Apr. 3, 1990, for INERT GAS CONTROL IN A SYSTEM TO REDUCE SPILLAGE OF OIL DUE TO RUPTURE OF A SHIP'S TANK, now U.S. Pat. No. 5,092,259 which predecessor applications are to the same inventor as the present application.

BACKGROUND OF THE INVENTION

1. Field of the Invention

The present invention generally concerns systems and methods for preventing or reducing the spillage of oil in the event of an accidental rupture of the tanks of a barge.

The present invention particularly concerns system and methods for creating, and for dynamically maintaining, a slight underpressure in the ullage space of the tanks of an unmanned barge which is generally towed by a tugboat.

2. Background Information

There are approximately 10,000 barges in the United States. As a group they are a principal polluter of inland waterways and coastal waters due to accidental ruptures in their hulls.

The Oil Pollution Act of 1990 mandates "Double Containment" for all barges less than 5,000 gross tons. "Double containment" within the meaning of the Act is not restricted to double hulls. Instead, it means any system that effectively prevent spillage of oil from an accidental rupture of the oil tanks of barges.

Barges under 5,000 gross tons are typically unmanned and without propulsion, i.e. they are not self propelled. The lack of these assets will be found to compatible to the present invention, which can be retrofitted to existing barges with minimum modifications.

2.1 Related Background to the Present Invention—Oil Spillage Avoidance

Avoidance of spillage from the rupture of tanks containing liquids—typically oil—is desirable on economic, environmental and aesthetic grounds. With the advent of supertankers, a single incidence of an oil spill from a large tanker can (i) cause significant damage to the environment, (ii) disrupt the ecological balance, and (iii) cause substantial economic loss. The accident of EXXON VALDEZ is perhaps the worst oil spillage disaster in U.S. history. The EXXON VALDEZ leaked about 240,000 barrels—over 10 million gallons of oil. The economic and environmental cost is estimated to have been over two billion dollars.

The predecessor, related, patent applications to the present application teach inventions for reducing or preventing any outflow of liquid, such as oil, due to the rupture of a tank, typically a ship's tank. The system, and method, of one related invention involves the creation, and the subsequent dynamic maintenance, of a partial vacuum in the effected tank or tanks. A partial vacuum below atmospheric pressure is preferably, and initially, created in the ship's tank before any rupture has occurred, and normally after a filling of the tank and before disembarkation of the ship. Thereafter the partial vacuum is continuously dynamically maintained in a precise balance responsive to the forces acting on the liquid contents of the tank, which forces change when the tank is ruptured. The dynamically maintained partial vacuum serves to hold the liquid contents of the tank within the tank even if, and when, the tank is ruptured—much in the manner that liquid is held within an inverted glass when the glass is pulled above the liquid level of a reservoir.

If the rupture is below the water line, and on the side of the ship's hull, then surface tension dynamics at the rupture between the tank's interior liquid, nominally oil, and the exterior water will induce a stratified flow, forcing water into the tank through the lower part of the rupture while forcing the liquid oil upward and out of the tank, oppositely to the flow of water. This stratified flow will continue until the water level reaches the top part of the rupture.

In one, preferred, embodiment of a related invention this stratified flow is stopped because a non-structural barrier, typically a tarpaulin, is placed over the rupture. The barrier is placed over the rupture even as, and while, the partial vacuum is dynamically maintained. The combination of dynamic underpressure control and the non-structural barrier substantially forestalls oil outflow—even below the level of the rupture.

SUMMARY OF THE INVENTION

The present invention contemplates the creation, and the dynamic maintenance, of a slight underpressure in the ullage space of the oil tanks of unmanned barges in order to prevent or reduce the spillage of oil due to any rupture of the tanks.

A slight underpressure in the ullage space of each sealed tank of a barge is created by means of a high pressure gas, preferably an inert gas, that is flow-connected to an ejector that is also flow-connected to the ullage spaces of the barge's tanks. In order that the gaseous mixture within the ullage space may be inerted so as to prevent combustion or explosion, still another, direct, third, flow connection is preferably made from the ullage space to the high pressure gas. Each of the three flow connections is through a valve, normally an electric valve.

Preliminarily to commencing operation of the ullage space underpressure system, the ullage gases are preferably inerted by addition of inert gas from a high pressure reservoir of such inert gas, normally nitrogen in tanks. During this inerting the excess gases from the ullage spaces are normally evacuated, typically at a tank position opposite to where the inert gas is being introduced, through the same ejector (which is not currently receiving any pressurized gas, nor involved in creating an underpressure condition) that is otherwise, and at a later time, involved in creating the underpressure.

After the tank is first (preferably) inerted, the slight underpressure is established, and thereafter dynamically maintained by a selective, valve-controlled, gating of both (i) the ullage space (inerted) gases and (ii) the high pressure gas to the ejector. Notably, the high pressure gas that is used to energize the ejector, and to produce a gaseous underpressure in the ullage space, need not be the, or an, inert gas. It may be, for example, simple compressed air. Normally, however, the same reservoir of compressed inert gas is used for (i) preliminarily inerting the ullage space, and, thereafter, (ii) energizing a gas ejector to produce an underpressure (less than atmospheric pressure) within the ullage space. Still further, optionally, the reservoir of compressed inert gas may be used for (iii) topping up the inert gas within the ullage space as the ingress of atmospheric gases (leakage) into the ullage space (which is at an underpressure) may require.

Electric valves serve to gate (i) the (compressed) inert gas to the ullage space, (ii) the compressed gas (which is normally the inert gas) to the ejector from which they are ejected to the atmosphere, and (iii) the ullage space gases to the ejector from which they also are ejected to the atmosphere. All electric valves are under the control of an electronic system, normally a small digital computer. The computer also receives inputs from sensors including pressure gauges, tank level indicators and ullage gas analyzers.

In response to sensed conditions the computer controls the various electric valves to gate the flow of both ullage space and high pressure gases for at least two purposes. First, the ullage space gases are mixed to, and maintained at, an inerted condition.

Second, the ullage space underpressure is dynamically maintained at a level that accords for any changes in the internal and external pressures on the liquid (normally oil) contents of the tank at the site of a rupture to the tank incipiently upon the occurrence of the rupture. This dynamic underpressure control is directed to balancing pressure forces at the precise location of a rupture even as these forces may change over time due to (i) barge loading (including during progressive offloading), (ii) changes in water levels (including if the barge is grounded), (iii) progressive leakage from the tank through the rupture, (iv) progressive offloading of the unspilled contents of the tank, and/or (v) still other factors. The dynamic underpressure control has a simple effect: the liquid (oil) inside the ruptured tank is prevented or inhibited from exiting the tank through the rupture. To a lessor extent the liquid (water) outside the ruptured tank is simultaneously inhibited from entering the tank.

Accordingly, in one of its embodiments the ullage space underpressure system for barges in accordance with the present invention includes one or more pressurized bottles of inert gas, an ejector, a computer, and one or more electric valves and sensors. There are virtually no moving parts except for the opening and closing of the electric valves. The computer is programmed in control of the entire system. The system accordingly requires virtually no human intervention during the voyage of the barge.

In its preferred mode of operation, the system in accordance with the present invention (i) inerts the ullage gases for additional safety, (ii) introduces automatic topping of the ullage space with inert gas to account for (typically negligible) vapor leakage. In its preferred embodiment the system (i) uses low cost marine, typically rechargeable, batteries as the energy source for the electronic system, and (ii) employs a ruggedized computer of the personal computer type to dynamically manage and control the slight underpressure in the ullage space.

These and other aspects and attributes of the present invention will become increasingly clear upon reference to the following drawings and accompanying specification.

BRIEF DESCRIPTION OF THE DRAWINGS

For a more complete understanding of the invention and for further objects and values thereof references are now made to the accompanying drawings referred to as FIGURES, which drawings include a Plan View Schematic of a Barge, a Piping Schematic of the System of the Invention, Ejector Characteristics, a Sample Barge Configuration, a Diagram of Hydrostatic Forces Stratified Flow Due to Side Hull Rupture, a System Schematic and a Table showing sample calculations for the required volume of compressed (inert) gas required for the ejector system to create an underpressure.

DESCRIPTION OF THE PREFERRED EMBODIMENT OF THE INVENTION

The present invention contemplates a system and method for preventing or reducing any flow of oil from a ruptured tank of a barge or similar vessel. The system of the present invention prevents the outflow of oil through a rupture of tank(s) by (i) creating an underpressure in the ullage space and (ii) dynamically maintaining the underpressure.

In a typical barge configuration, a puncture at the bottom shell usually means the hydrostatic pressure at the level of puncture inside the tank is higher than the surrounding column of water. The application of slight underpressure at the tank ullage effectively equalizes the pressure inside and outside the tanker at the ruptured area. When a rupture occurs, the water displaces the oil up to the top of the ruptured area. If pressure equalization at this point of the rupture is achieved then no further spillage occurs.

The hydrostatic overpressure depends on many factors such as cargo density, loading conditions, barge configuration, and the height of the tank rupture from the tank bottom. Generally, the underpressure required to equalize forces inside and outside a tanker barge is moderate 0.4 to 1.5 psi. However, the equalization of forces across the height of the tank rupture area does not prevent leakage up to that point because of probable surface tension forces between the two dissimilar fluids at the hole, resulting in stratified flow.

Figure 4:
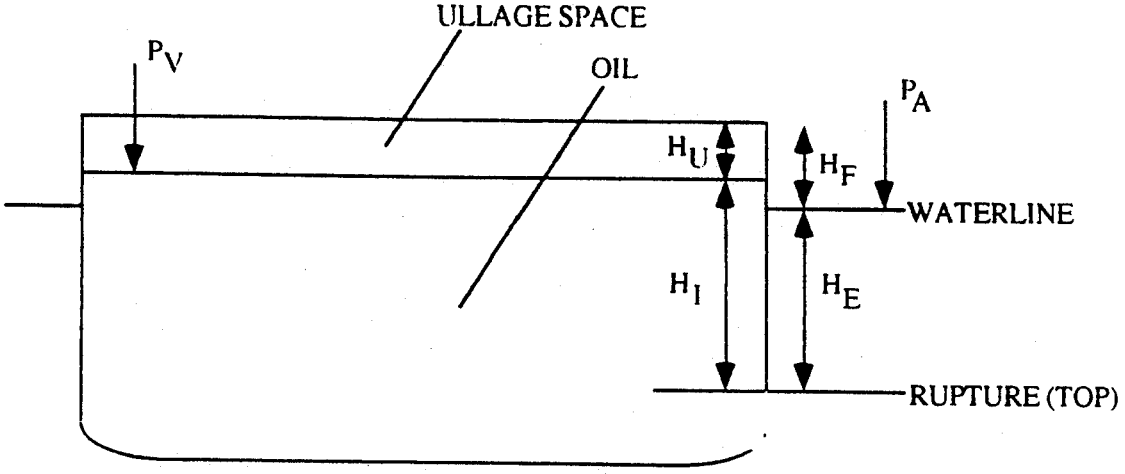
FIG. 4 is diagram of the hydrostatic forces acting on the liquid contents of a tank of a barge after a rupture to the tank.

A typical tank of a barge is shown in cross-section in FIG. 4. The tank exhibits a grounding-type rupture such that the distance from the water-line to the top of the rupture is $h_e$ and the height of the rupture contained oil above the top of the rupture is $H_i$. The ullage as depicted has a controlled underpressure $P_v$. The underpressure can be set to balance the forces internal to and external to the tank at the highest point of rupture so that oil spillage will only occur up the highest point of the ruptured opening. The forces that predominate are the hydrostatic fluid pressures and the ambient and underpressure forces, as follows:

*External Pressure ($P_e$)=Atmospheric Pressure ($P_a$)+Hydrostatic Water Pressure ($D_w x H_e$)*

*Internal Pressure ($P_i$)=Controlled Ullage Pressure ($P_v$)+Hydrostatic Oil Pressure ($D_o x H_i$)*

Where:

H is the hydrostatic head, and

D is the density of fluids.

For Equilibrium:

$$P_e - P_i = 0, \text{ or}$$

$$P_v = P_a + D_w x H_3 - D_o x H_1 \quad (1)$$

For example, where:

$H_e$=9.4 ft.

$H_i$=12.25 ft.

$D_w$=Density of Water=64 lb/ft$^3$ $D_o$=Density of Oil=57 lb/ft$^3$ $P_a$=atmospheric pressure=14.7 psia Then, from equation (1)

$$\begin{aligned} P_v &= 14.7 \times 144 + 64 \times 9.4 - 57 \times 12.25 \\ &= 2020 \text{ (psf)} \\ &= 14.02 \text{ psia} \end{aligned}$$

The under pressure as defined is the pressure change required below atmospheric pressure (14.7 psia) to sustain equilibrium of forces:

$$\begin{aligned} \text{Underpressure} &= P_a - P_v \\ &= 14.7 - 14.02 \\ &= .68 \text{ psia} \end{aligned}$$

To repeat, the underpressure to satisfy the pressure forces external to and internal to the tank at the location of the ruptured hole is dependent on many factors, including cargo density, tank loading conditions, draft and the height of the rupture from the waterline.

The manner by which the system of the present invention may automatically sense such necessary quantities as permit the dynamic adjustment, and control, of ullage space underpressure incipiently upon the occurrence of a rupture of undetermined location is simplified because unknown variables $H_e$, or the depth of the rupture below waterline, and H:, or the depth of the rupture below the liquid contents of the tank, are not independent. In particular, $$H_e + H_f = H_i + H_u, \text{ or}$$

$$H_i = H_e + H_f - H_u$$

where new variables $H_f$=freeboard height, and $H_u$=height of the ullage space.

The height of the ullage space $H_u$ is determinable by a tank level indicator and the computer's prior information on the construction of the barge, and the height of its tanks. Likewise the freeboard height $H_f$ is determinable by level sensors, floats connected to transponders, and other common instrumentation that is mountable to the hulls of ships (or barges) in order to determine how deep the ship (or barge) rests within the water.

The equation (1) may be solved for the determinable quantities as follows:

$$\begin{aligned} P_v &= P_a + D_w \times H_e - D_o \times H_i \\ &= P_a + D_w \times H_e - D_o \times (H_e + H_f - H_u) \\ &= P_a + D_w \times H_e - D_o \times H_e - D_o \times H_f - D_o \times H_u \\ &= P_a + D_o (H_u - H_f) + H_e (D_w - D_o) \text{ or,} \\ H_e &= (P_v - P_a + D_o (H_u - H_f))/(D_w - D_o \end{aligned}$$

All the terms on the right of the equation are known to the system. Accordingly, the height of the rupture $H_e$ may be solved.

The solution is slightly more complex if the barge contains more than one tank with the remaining tanks unruptured. These tanks presenting no ruptures merely contribute in a static manner to the freeboard height $H_e$. The terms presented by these tanks are purely additive, and do not affect the ability to make an automated determination of the rupture location and, resultantly thereto, such adjustment of the ullage space underpressure as is required.

Figure 5:
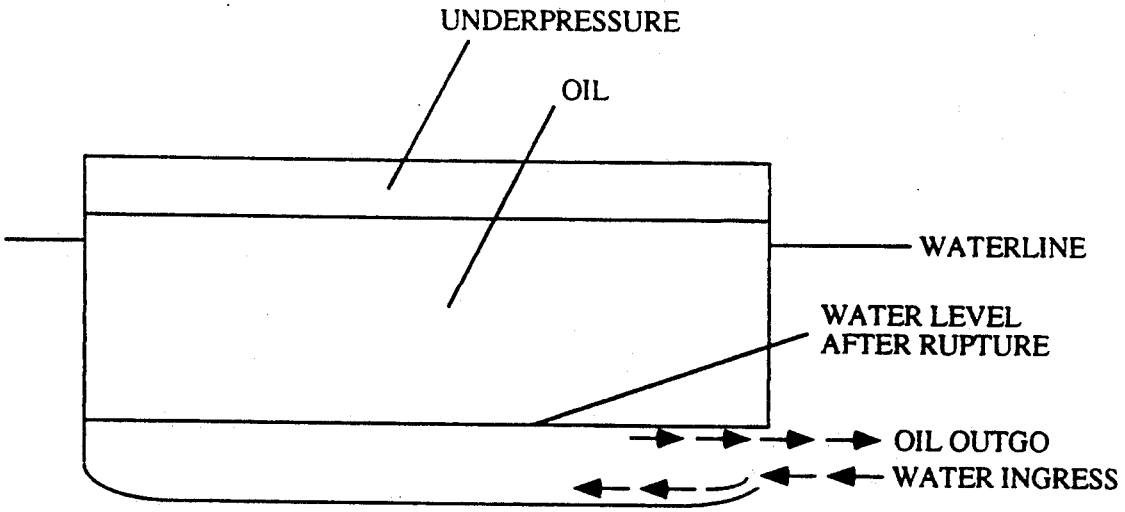
FIG. 5 is a diagram of the stratified flow, occurring due to surface tension, at the rupture to the tank of a barge.

Merely establishing the pressure equilibrium as determined by the equations works nicely to control outflow of oil from a ruptured tank in all cases so long as the viscosity (not the density, the viscosity) of the contents inside the tank and the liquid outside the tank is the same. However, this is seldom the case. The viscosity of oil does not commonly equal the viscosity of oil. Based on experimental evidence it appears that, because of surface tension forces between the two dissimilar viscous fluids, in this case (crude) oil and water, the water is drawn into the tank through the lower part of the hole, as shown in FIG. 5. A stratified flow results, even though equilibrium of pressure is maintained throughout. Once the water reaches the top part and the viscosity of liquid inside the tank is the same as outside, the flow stops and the equilibrium state is reached again.

Because most ruptures occur at the bottom of tanks, the dynamic underpressure system of the present invention is certainly of value even if it fails to prevent stratified flow. However, the present invention contemplates that, time and resource permitting, measures may be taken to abate even the stratified flow. These measures are all concerned with the placement of a non-structural barrier —i.e., a mechanically non-load-bearing separation—between the two liquids of differing viscosities. A simple tarpaulin, or a sheet of even quite thin plastic, if maneuvered into position on either side of the rupture will serve to separate the oil and water, and to prevent stratified flow. A chemical barrier, such as several types of foams and gels, will also suffice as a non-structural barrier. It must be understood that the goal of such a barrier is never to forcibly prevent the flow of fluids across a rupture—which is the function of the underpressure system—but merely to, as much as is possible, separate the fluids of differing viscosity.

Most small barges, especially those under 5,000 gross tons, have no provision to carry humans, nor, in most cases, to support the intervention of humans. The preferred ullage space underpressure system of the present invention is therefore preferably totally automated. It basically consists of compressed inert gas bottle(s) coupled to an ejector that is controlled by simple sensors and a sealed, PC type, computer, to create and to dynamically maintain, an ullage space underpressure.

Figure 1A:
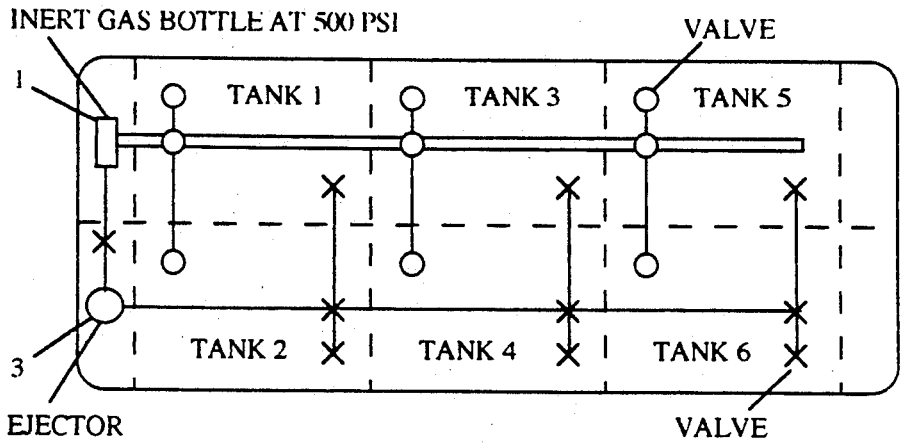
FIG. 1A is a diagram showing a plan view schematic of a barge within which the ullage space underpressure system of the present invention is installed.
Figure 1B:
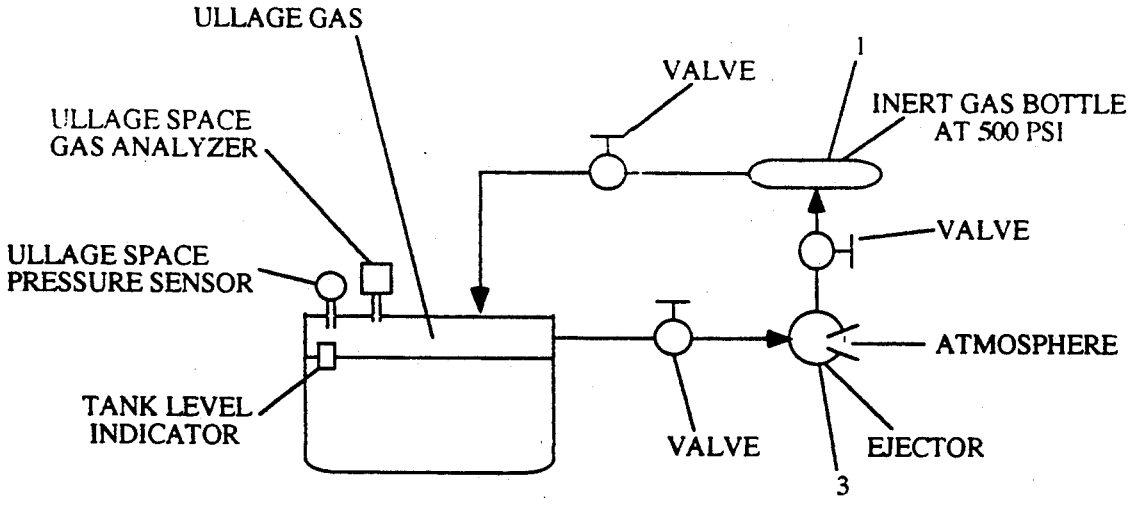
FIG. 1B is a sectional schematic of the ullage space underpressure system of the present invention as installed in a barge.

The plan view schematic FIG. 1A and sectional schematic FIG. 1B show a preferred arrangement of the system. The system consist of a source of compressed, preferably inert, gas 1 coupled to a single stage ejector 3 that will compress and transfer the ullage gas from its underpressure condition (typically 13.2 psia) to either the atmosphere or to a inerted container (not shown) for final disposal.

The ejector 3 is a static pump with no moving parts. It uses the high velocity jet of stored gas to mix with the low velocity ullage gas. Therefore, through a conservation of the momentum of the streams, a mixture of stored gas and ullage gas streams out of the ejector at an intermediate velocity that is converted by means of a diffuser to a pressure higher than the original ullage gas pressure.

Figure 2A:
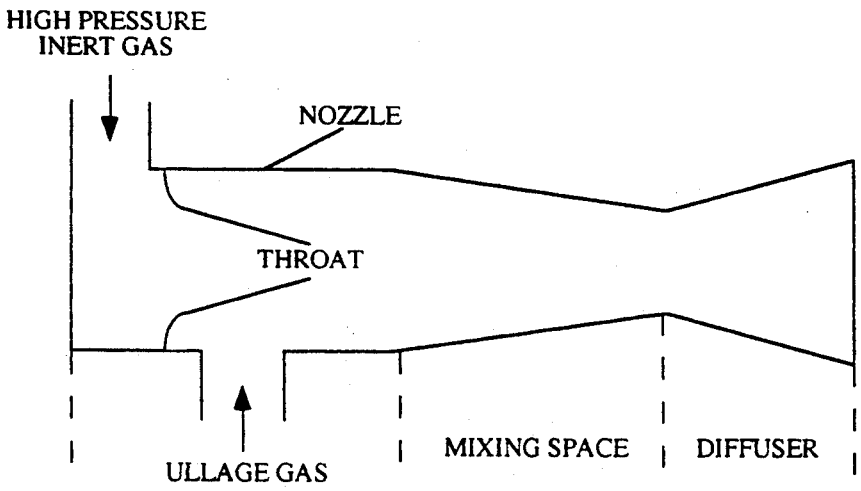
FIG. 2A is a diagrammatic representation of an injector used in the preferred embodiment of the ullage space underpressure system of the present invention as installed in a barge.
Figure 2B:
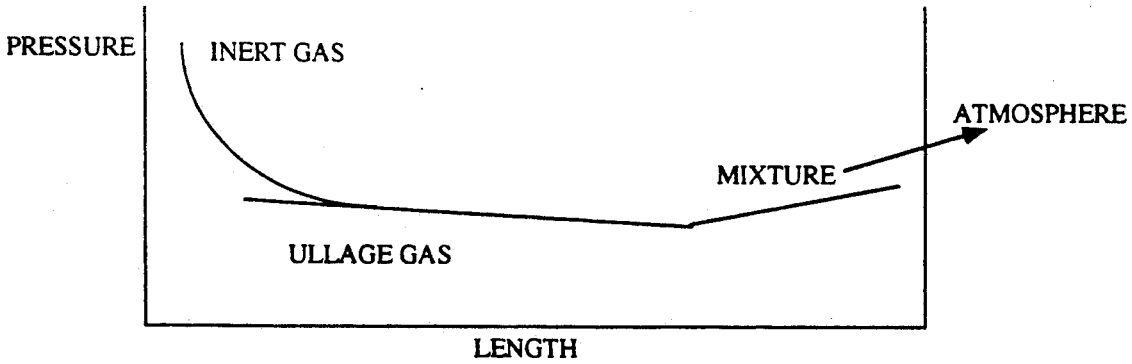
FIG. 2B is a diagram of the characteristics of the ejector shown in FIG. 2A.

The operation of the ejector 3 and its diffuser is diagrammed in FIG. 2. The ejector 3 throttles down the stored pressure so that the stored compressed gas exits the end of the convergent nozzle at Mach 1, or sonic, velocity. The areas of the conic throat and ullage stream passage are sized to permit a weighted flow from each stream so that, with the exchange of momentum between the two streams (momentum equals mass x velocity), an adequate velocity is available to the mixed stream that passes through divergent diffuser passage. The diffuser acts to convert the kinetic energy of the mixed stream into pressure energy, and thus meets the exit pressure requirements (atmospheric pressure or container pressure).

Still further, the present system is preferably operative to inert the ullage space during an initial drawdown of pressure by the ejector and during any topping operations performed to account negligible vapor leakage. This will ensure that the ullage space remains out of the range of flammability no matter what operations are in progress.

Figure 6:
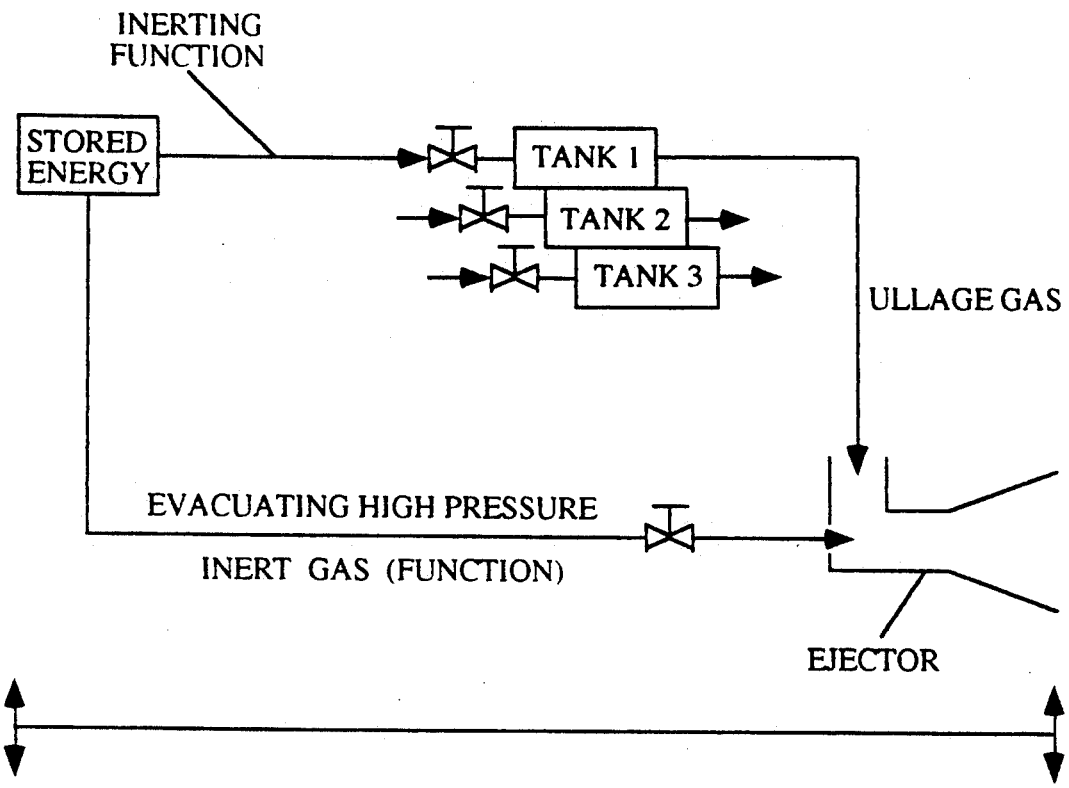
FIG. 6 is a schematic diagram of a preferred embodiment of an ullage space underpressure system in accordance with the present invention.

All operations of the present operations are automatically monitored and controlled by means of sensors and a computer. The primary resources required for the system, shown in FIG. 6, are: (i) Inert Gas Bottle(s), (ii) Ejector, (iii) Tank Level Indicators, (iv) Draft Level Indicators, (v) Gauges & Sensors, (vi) PC type Computer - Sealed, (vii) Air Tubing, (viii) Control Valves (air), (ix) Relief Valves, (x) Rechargeable Batteries (Explosion Proof), (xi) Alarms, and (xii) Shut Off Valves.

An operational sequence for the preferred system are as follows. First, a barge is loaded with cargo while the ullage gas is monitored and inert gas is introduced to ensure the inert condition of the ullage gases.

Second, an ullage space underpressure is initiated prior to start the voyage. The reduction of ullage pressure is performed by the ejector exhausting the inerted ullage gas down to the desired value.

Third, the underpressure is dynamically maintained, including any such maintenance as is required due to topping the ullage space with additional inert gas automatically during the voyage. This topping off is in response to inputs from the sensors in the tank to the computer. Responsively to these inputs, the computer automatically adjusts the pertinent valves for flow of the inert gas.

The primary resources required to implement the ullage space underpressure system of the present invention as installed on barges are as illustrated and listed in FIG. 6. The include:

a. Inert Gas Bottle(s) (Pressurized)
b. Ejector (Air)
c. Tank Level Indicators
d. Draft Level Indicators
e. Gauges & Sensors
f. Sealed Computer
g. Air tubing
i. Control Valves (air)
j Emergency Transfer System Discharge Pipes
k. Relief Valves
l. Rechargeable Batteries (Explosion Proof)
m. Alarms, and
n. Shut Off Valves.

The system for barges virtually, has no moving parts, and the consumable items (FIG. 6) in the system are inexpensive: compressed air and/or compressed inert gas and rechargeable batteries are the only two consumable items. The system of the present invention is rugged, low cost, and highly reliable in operation.

Certain sample calculation for the ejector sizing and other parameters of system construction and operation are as follows.

Consider as a first option that ullage gases are released to the atmosphere in the course of setting the underpressure, and also when maintaining underpressure in the ullage space. Typical factors are:

*Ullage volume*=2000 $ft^3$ (*all tanks*)

*Initial ullage pressure* 14.7 *psia*

*Final ullage pressure* =13.2 *psia* [*underpressure*]

*Ullage gas temperature*=100° *F.*

*Initial ullage gas density*=0.1 $lb/ft^3$

The weight of ullage gas removed in setting the underpressure is calculated as follows:

$$\text{Initial ullage gas weight} = \text{Density} \times \text{Volume} = 0.1 \times 2 \times 10^3 = 200 \text{ lbs.}$$

$$\text{Final ullage gas weight} = \text{Density} \times \text{Volume}$$

$$\text{Final Density} = \frac{\text{Pressure Final}}{\text{Pressure Initial}} \times \text{Initial Density} = \frac{13.2}{14.7} \times 0.1 = 8.9 \times 10^{-2} \text{ lb/ft}^3$$

$$\text{Final ullage gas weight} = 8.9 \times 10^{-2} \times 2 \times 10^3 = 179 \text{ lbs}$$

$$\text{Weight of gas removed} = 200 - 179 \text{ lbss} = 21 \text{ lbs.}$$

to remove this ullage space gas a single stage ejector is used operating with a high pressure inert gas or nitrogen source. A high velocity jet stream is introduced into a mixing chamber that is open to the ullage case exit duct. The high pressure nitrogen is throttled and expanded to sonic velocity [Mach 1] in a convergent nozzle. The high energy jet stream imparts its momentum to the low energy ullage gas stream resulting in a mixed stream of intermediate energy. This energy is recovered as pressure in the adjoining divergent diffuser sufficient to expel the stream into the atmosphere.

*Ejector Velocity* $(V_c)=\sqrt{g\gamma RT}=$ *Sonic Velocity* where g=gravitational constant $\gamma$=ratio of specific heats=1.4

R=gas constant=54

T=gas temperature (70° F.)

$$V_c=(32\times1.4\times54\times530)^{\frac{1}{2}}=1132\ fps.$$

Figure 3A:
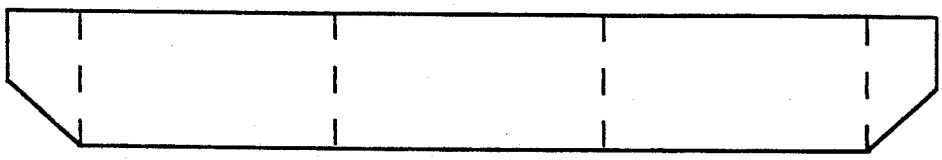
FIG. 3, consisting of FIGS. 3A through 3C, are prior art configuration diagrams of a sample barge within which the ullage space underpressure system of the present invention is installed.
Figure 3B:
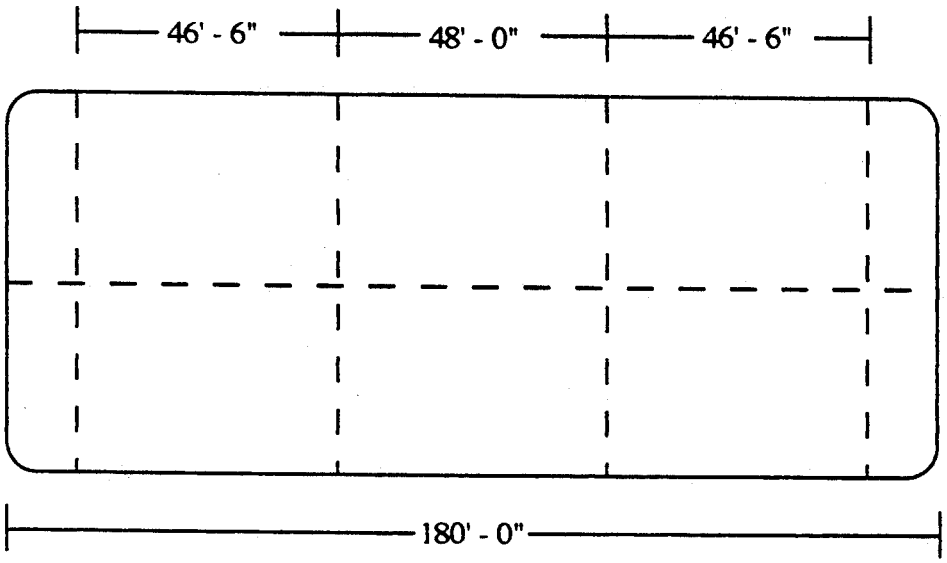
Figure 3C:
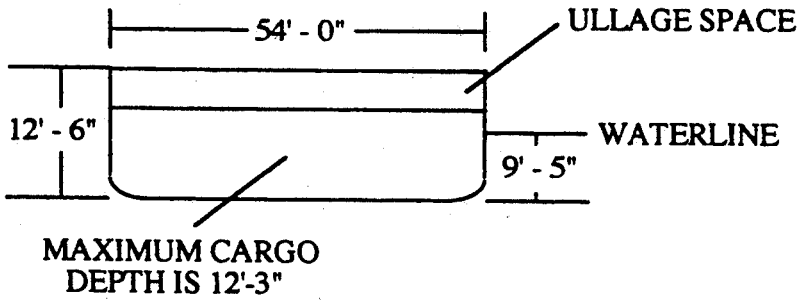

The mixing chamber of the ejector 3 (shown in FIGS. 1-3) can be sized to pass 1 lb/sec of ullage gas flow and the throat of the ejector nozzle to pass 2 lb/sec of flow.

Applying the conservation of momentum, the Momentum of ejector stream plus the momentum of ullage stream equals the momentum of the mixed streams. Remembering that momentum equals mass times velocity, and that the mass of the ejector gas is typically twice (×2) that of the ullage gas, $$2\times1132+1\times100=3\times V_x$$

where $V_x$ is the intermediate velocity after mixing. Accordingly,

*The intermediate velocity after mixing* $(V_x)=788$ *fps.*

If totally converted to pressure in an infinite diffuser $$\begin{aligned}\text{Pressure} &= \frac{1}{2}\ \frac{fV_x^2}{g}\\ &= \frac{1}{2}\times\frac{0.1\ (788^2)}{32\times144}\\ &= 6.7\ \text{psia}\end{aligned}$$

A practical diffuser could reduce the velocity ($V_x$) to half this value, at least.

$$\begin{aligned}V &\propto \frac{1}{2}\\ \text{Pressure} &\propto V^2\\ \text{Pressure} &= \frac{1}{2}\times\frac{0.1\times399^2}{32\times144}\\ &= 1.7\ \text{psi}\end{aligned}$$

or the ejector can pump from 13.2+1.7=14.9 psia to be able to expel the ullage gas into the atmosphere.

The size of the inert gas or nitrogen storage bottle is calculated as follows:

$$\begin{aligned}W_{N2} &= 2\ (\text{weight of ullage gas removed})\\ &= 2(21)\\ &= 42\ \text{lbs.}\end{aligned}$$

-continued $$\begin{aligned}\text{Storage pressure} &= 500\ \text{psia.}\\ \text{Temperature } T &= 70°\ \text{F.}\\ \text{Density}_{nitrogen} &= P_N=\frac{p}{RT}\\ &= \frac{500\times144}{54\times530}\\ &= 2.5\ \text{lb/ft}^3\\ (V)\text{Volume} &= \frac{\text{Weight}}{\text{Density}}=\frac{42}{2.5}=16\ \text{ft}^3\\ \text{Equivalent sphere diameter} &= \left(\frac{6}{\pi}\times V\right)^{\frac{1}{3}}\\ &= 3.13\ \text{ft.}\end{aligned}$$

As still another, second, option, during operation of the system all discharge of the ullage gases may be contained and not released to the atmosphere. In this case, and as previously estimated, the total ullage gas required to be removed to set the ullage underpressure was 21 lbs.

Assume the stored container is partially evacuated and then hooked up to the ejector discharge duct:

*Weight of ullage gas=21 lbs.*

*Final pressure of stored container=14.7 psia*

*Weight of nitrogen (ejector) gas=2×21=42 lbs.*

*Total weight of gas for container=63 lbs.*

*Density of nitrogen at STP=0.1 lb/ft*$^3$ $$\begin{aligned}(V)\ \text{Volume of container} &= \frac{\text{Weight of Gas}}{\text{Density of Gas}}\\ &= \frac{63}{0.1}\\ &= 630\ \text{ft}^3\\ \text{Equivalent sphere diameter} &= \left(\frac{6}{\pi}\times V\right)^{\frac{1}{3}}\\ &= \left(\frac{6}{\pi}\times 630\right)^{\frac{1}{3}}\\ &= 106\ \text{ft.}\end{aligned}$$

If this storage container is too large, there are adequate techniques for reducing its size by using a higher performance ejector permitting the storage of gases at a higher pressure.

The method and system of the present invention accommodates volatility in the liquid cargo. The technical prerequisites with regard to the vapor pressure of different oil qualities must ensure that the oil remains a liquid at all times. This maintenance of the liquid state requires an externally imposed pressure that exceeds the saturated vapor pressure corresponding to the temperature of the oil. True vapor pressures of a range of highly volatile cargos such as motor gasoline, aviation gasoline and light naphtha are at most 5 psia at stock temperature of 60 degree Fahrenheit, and up to 10 psia at stock (cargo) temperature of 100 degree Fahrenheit. The underpressure requirement of approximately 13 psia ullage pressure space will not cause boiling to occur even with volatile fuels of vapor pressure approaching 10 psia.

The method and system of the present invention is compatible with a barge's structural capability to withstand underpressure in the hold. Based on structural capability of each barge, a "not to exceed structural strength" relief valve is preferably provided in each tank of the barge, to prevent buckling of the structure of the barge, to prevent such an accidental, runaway, underpressure as might damage or hazard the structural integrity of the barge.

In accordance with the preceding discussion, several adaptations and alterations of the system of the present invention will suggest themselves to practitioners of the gas flow control arts. The underpressure may be drawn by pumps, or by remote connections to vacuum sources such as may be powered by the tugboat hauling one or more barges. In this manner the barges would be connected for air pressure much in the manner that the units of a large, over-the-road, tractor trailer dolly-trailer are connected for air brakes. The inert gas need not be stored on the barge, nor even in tanks, but can, for example, originate as the flue gases of the engine(s) of the tugboat.

In consideration of these and other possible adaptations and alterations of the present invention, the invention should be considered broadly, in accordance with the following claims only, and not solely in accordance with that particular preferred embodiment within which the invention has been taught.

What is claimed is:

1. A system for creating an underpressure in the ullage space of a tank of a vessel comprising:
a source of a high pressure gas;
an ejector flow-connected to the source and also flow-connected to the ullage space of the vessel's tank in order that high pressure gas from the source may energize an evacuation of gases from the ullage space in and by the ejector so as to create an underpressure less than atmospheric pressure within the ullage space.

2. The system for creating an underpressure in the ullage space of a tank of a vessel according to claim 1 wherein the source of high pressure gas comprises:
inert gas.

3. The system for creating an underpressure in the ullage space of a tank of a vessel according to claim 2 further comprising:
a flow connection from the ullage space to the source of high pressure inert gas;
wherein the ullage space may be inerted with inert gas from the source of high pressure inert gas;
the same source of high pressure inert gas that serves to energize the ejector in order to evacuate the gases from the ullage space also serves to inert the gases within the ullage space.

4. The system for creating an underpressure in the ullage space of a tank of a vessel according to claim 3 further comprising:
a first controllable valve within the flow connection of the ejector to the source of high pressure inert gas;
a second controllable valve within the flow connection of the ejector to the ullage space of the vessel's tank;
a third controllable valve within the flow connection from the ullage space to the source of high pressure inert gas; and
a control means for controlling the third controllable valve so that the ullage space gases are inerted by addition of inert gas from the source of high pressure inert gas.

5. The system for creating an underpressure in the ullage space of a tank of a vessel according to claim 4
wherein the control means is also controlling the second controllable valve so that the pressure substantially above atmospheric pressure does not accumulate in the ullage space during inerting of the gases therein by act of adding inert gas from the source of high pressure inert gas;
wherein by this control of the second controllable valve excess gases from the ullage spaces are evacuated through the ejector.

6. The system for creating an underpressure in the ullage space of a tank of a vessel according to claim 4
wherein the control means is also controlling, at a time after an initial inerting of the gases within the ullage space, the third controllable valve so that it is positioned off, and the first and the second controllable valves so that they are positioned on, so that by these valve positionings an underpressure is established, and thereafter maintained;
wherein a selective, first and second valve-controlled gating of both (i) the inerted ullage space gases and (ii) the high pressure gas to the ejector serves to energize the ejector, and to produce the gaseous underpressure less than atmospheric pressure in the ullage space.

7. The system for creating an underpressure in the ullage space of a tank of a vessel according to claim 1 further comprising:
a first controllable valve within the flow connection of the ejector to the source of high pressure inert gas;
a second controllable valve within the flow connection of the ejector to the ullage space of the vessel's tank; and
a control means for controlling the first and the second controllable valves so that they are positioned on in order that the underpressure less than atmospheric pressure is established within the ullage space;
wherein the control of the first and second valves to gates of both (i) the ullage space gases and (ii) the high pressure gas to the ejector serves to energize the ejector, and to produce a gaseous underpressure in the ullage space.

8. The system for creating an underpressure in the ullage space of a tank of a vessel according to claim 7 wherein the source of high pressure gas comprises:
inert gas; and wherein the system further comprises:
a flow connection from the ullage space to the source of high pressure inert gas; and
a third controllable valve within the flow connection from the ullage space to the source of high pressure inert gas; and wherein the control means is further controlling the third controllable valve so that the ullage space gases are inerted by addition of inert gas from the source of high pressure inert gas.

9. The system for creating an underpressure in the ullage space of a tank of a vessel according to claim 7 further comprising:
an electronic means for controlling the first and the second controllable valves.

10. The system for creating an underpressure in the ullage space of a tank of a vessel according to claim 9 wherein the electronic means comprises:

a computer.

11. The system for creating an underpressure in the ullage space of a tank of a vessel according to claim 9 further comprising:

an ullage space pressure sensor communicating ullage space pressure to the electronic means.

12. The system for creating an underpressure in the ullage space of a tank of a vessel according to claim 9 further comprising:

a tank level indicator communicating the level to which the vessel's tank is filled to the electronic means.

13. The system for creating an underpressure in the ullage space of a tank of a vessel according to claim 9 further comprising:

an ullage space gas analyzer communicating the gaseous contents of the ullage space to the electronic means.

14. A method of creating an underpressure in the ullage space of a tank of a vessel comprising:

inerting the gases within the ullage space by adding to these gases an inert gas from a source of such inert gas; and the energizing a gas ejector, flow-connected to the ullage space and to a source of pressurized gas, with pressurized gas from the source of pressurized gas to eject inerted gases from the ullage space in order to produce an underpressure less than atmospheric pressure within the ullage space.

15. The method of creating an underpressure in the ullage space of a tank of a vessel according to claim 14 further comprising:

topping up the inert gas within the ullage space as any leaked ingress of atmospheric gases into the ullage space, which is at the underpressure less than atmospheric pressure, may require in order that the mixture of gases within the ullage space should be maintained inerted.

16. The method of creating an underpressure in the ullage space of a tank of a vessel according to claim 15 wherein each of the inerting, the energizing, and the topping up is by gaseous flow through controllable valves.

17. The method of creating an underpressure in the ullage space of a tank of a vessel according to claim 16 wherein each of the gaseous flow through controllable valves is so controlled by an electronic system.

18. A method of managing the gases with the ullage space of a tank of a vessel comprising:

first gating pressurized inert gas to the ullage space until the mixture of gases therein is inerted; then second gating pressurized gas to an ejector simultaneously that the inerted gas mixture of the ullage space is also gated to the ejector so that all gated gases received by the ejector are ejected to the atmosphere;

wherein by the ejection an underpressure less than atmospheric pressure can be created in the ullage space.

19. The method of managing the gases with the ullage space of a tank of a vessel according to claim 18 further comprising:

repeating the first gating of the pressurized inert gas to the ullage space so that the mixture of gases therein may be maintained inerted even though the ullage space may, as a result of being at an underpressure less than atmospheric pressure, suffer the leaked ingress of some atmospheric gases.

20. The method of managing the gases with the ullage space of a tank of a vessel according to claim 18 wherein the first gating and the second gating is to the effect that the ullage space underpressure is dynamically maintained at a level that accords for any changes in the internal and external pressures on liquid contents of the tank at the site of a rupture to the tank incipiently upon the occurrence of the rupture.

* * * * *